United States Patent [19]

Covey, III

[11] 4,441,278

[45] Apr. 10, 1984

[54] MOUNTING FOR ENDLESS SEALING STRIPS

[75] Inventor: George H. Covey, III, Pawling, N.Y.

[73] Assignee: The Presray Corporation, Pawling, N.Y.

[21] Appl. No.: 320,427

[22] Filed: Nov. 12, 1981

[51] Int. Cl.[3] ..... E06B 7/16

[52] U.S. Cl. ..... 49/477; 49/488; 49/489; 49/498

[58] Field of Search ..... 49/477, 488, 489, 479, 49/498

[56] References Cited

U.S. PATENT DOCUMENTS 3,198,779 4/1965 Clark et al. ..... 49/477
3,397,490 8/1968 Carlson ..... 49/477 X

FOREIGN PATENT DOCUMENTS 899225 7/1944 France ..... 49/479

*Primary Examiner*—Kenneth Downey
*Attorney, Agent, or Firm*—Mandeville and Schweitzer

[57] ABSTRACT

The disclosure relates to an assembly of a closure element, such as a door, and a continuous, endless inflatable seal. An advantageous arrangement provided for effectively continuous support of the seal without requiring clamps or the like. The seal has a mounting or base flange which is continuous, except for a limited notch. The base flange is received in a mounting slot or groove, which is also continuous except for a notch of limited length. The endless seal is installed by initially inserting the base flange into the retainer groove, in the area of the notches, and sliding the endless seal member lengthwise into the retaining slot until the entire base flange is contained within the slot. Continuous mounting support is thus provided, except in the limited area of the notches, providing for a mounting of superior strength and reliability.

8 Claims, 10 Drawing Figures

FIG. 1
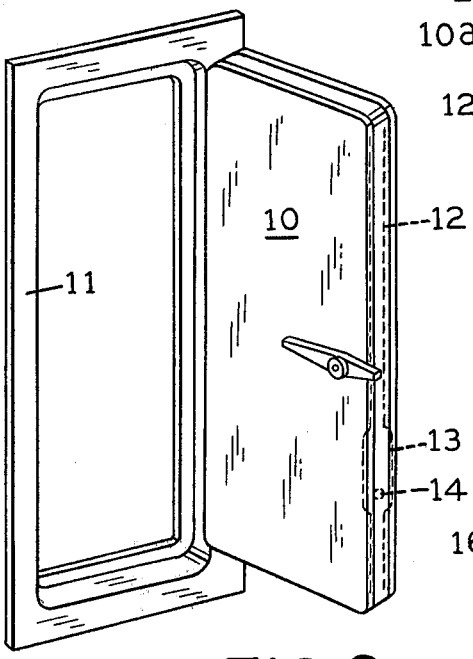
FIG. 4
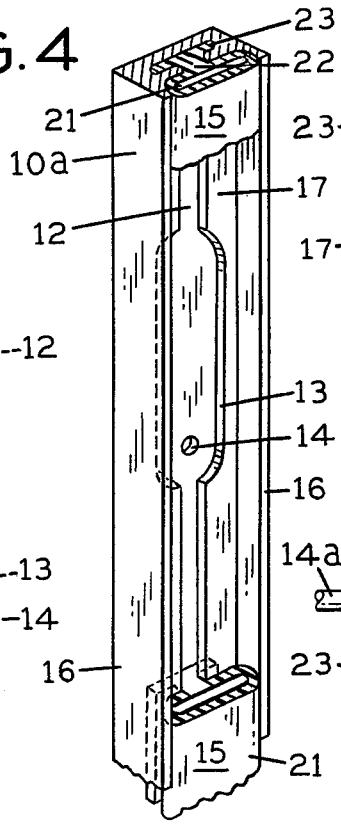
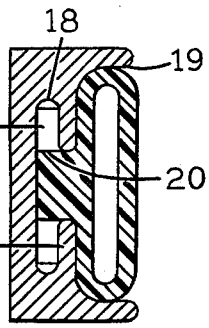
FIG. 7
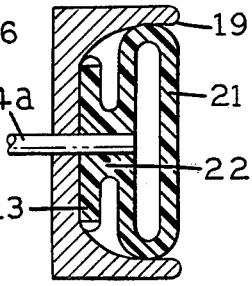
FIG. 8
FIG. 2
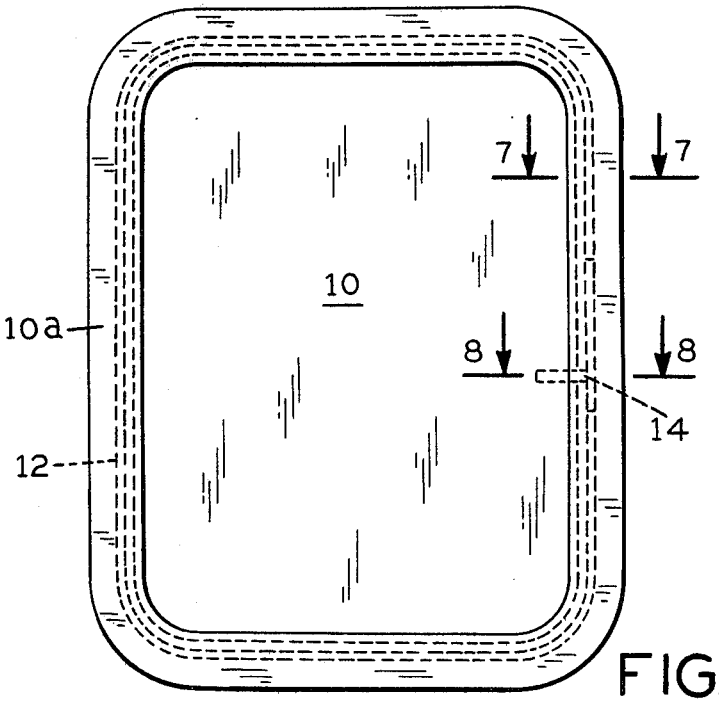
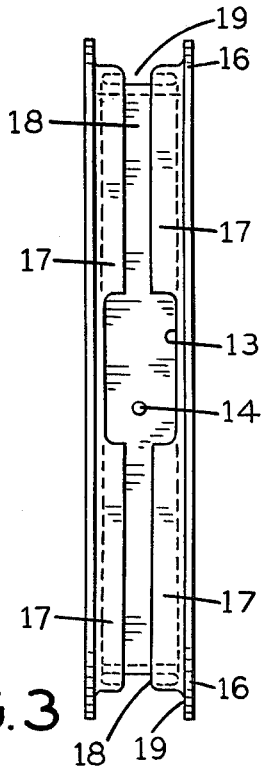
FIG. 3

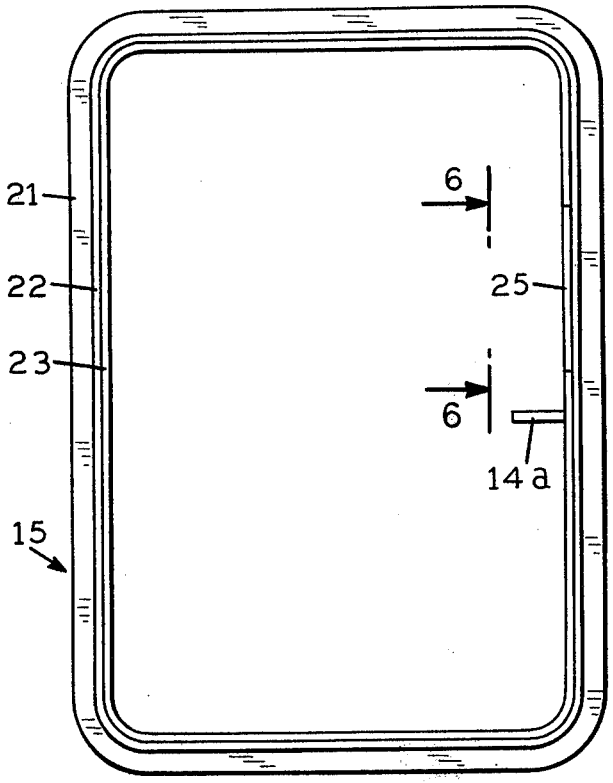
FIG.5
FIG.6
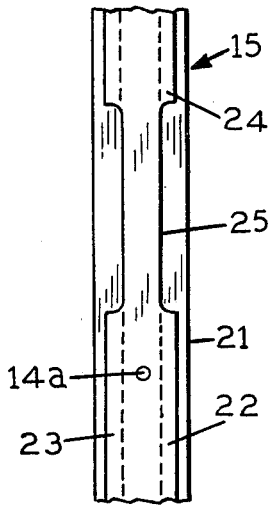
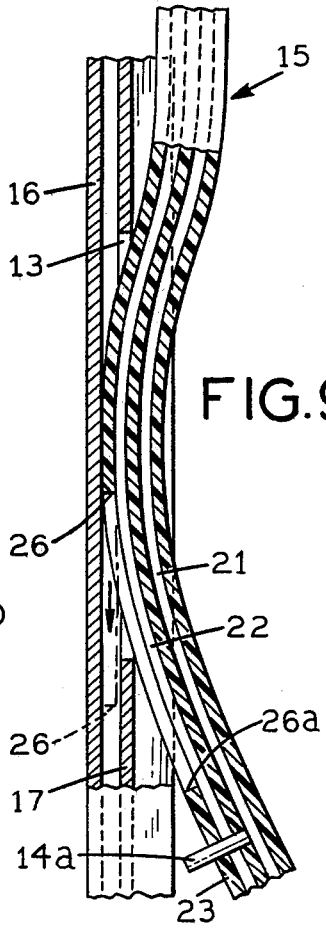
FIG.9
FIG.10
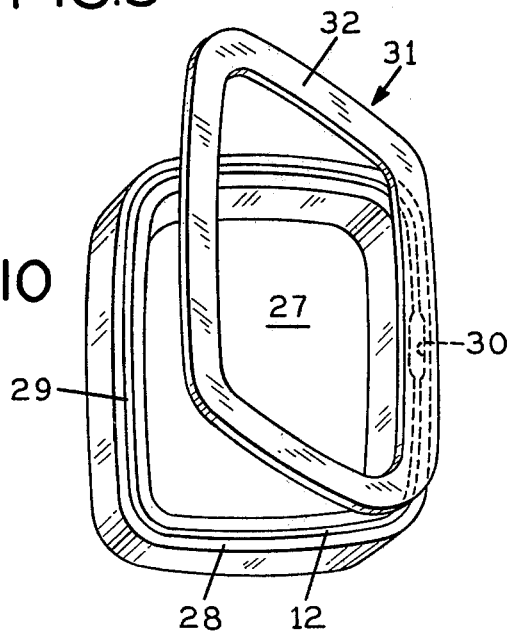

MOUNTING FOR ENDLESS SEALING STRIPS

BACKGROUND OF THE INVENTION

In a wide variety of closure applications, it is desirable to employ, in connection with the door or other closure element and its surrounding frame, a sealing element which may be inflated after shutting the closure element, to complete the seal. Typical applications employing such sealing means to advantage include environmental test chambers, water tight and/or dust free enclosures, and the like. Inflatable sealing strips are well suited for such applications because of their adaptability to uneven surfaces and their capability of being adjusted to various degrees of firmness by using different inflation pressures.

However, since these seals would be used in critical applications, it is of primary importance that they be easily replaceable when and if they fail. Ideally, replacement should be accomplished without making any structural changes to the door or hatch on which the seal is used since such operations tend to create additional possibilities of leakage and are time consuming. An advantageous form of sealable closure of this sort is disclosed in the Carlson U.S. Pat. No. 3,397,490. There, a flexible sealing strip is attached to a closure member, such as a door frame, by intermittently spaced, staggered clips, providing for installation and removal of the strip by flexing the strip in serpentine fashion along its longitudinal axis.

It is an object of this invention to provide an improved form of sealable closure of the general type shown in the above-mentioned Carlson patent. In particular, the invention provides a continuous, inflatable seal arrangement which is readily installed and removed, yet is ruggedly and securely held in place despite rough handling and/or extended and severe use.

SUMMARY OF THE INVENTION

The above objective is achieved by providing an endless sealing strip which is held in a substantially continuous groove in a surface of the closure member. Fins running alongside and overhanging the edges of the groove form an inner channel, and the sealing strip has a base flange along its entire length which fits slidingly in this channel, securing the sealing strip at all points. To allow the sealing strip to be installed or removed, both the base flange and the fins are notched in a limited area. The base flange may be inserted in the inner channel at this notched area, and the sealing strip slid along the groove 360° until it is fully mounted therein. When the sealing strip of the invention is thus mounted, the sealing strip is securely held along its entire length, so that it cannot droop.

For a more complete understanding of an exemplary embodiment of the invention, reference should be made to the following detailed description and to the accompanying drawings.

BRIEF DESCRIPTION OF THE DRAWINGS

FIG. 1 is a view of a door and frame assembly incorporating the seal of the present invention.

FIG. 2 is a front elevational view of a grooved frame for mounting the sealing element of the present invention.

FIG. 3 is an end elevation of the frame of FIG. 2.

FIG. 4 is a fragmentary perspective view, partially in cross section, of the assembly of the present invention.

FIG. 5 is a front elevational view of the sealing strip incorporated in the assembly of the present invention.

FIG. 6 is a fragmentary view end elevation of the sealing strip of FIG. 5 as viewed along line 6—6 of FIG. 5.

FIGS. 7 and 8 are cross sectional views of the new assembly as taken generally on lines 7—7 and 8—8 respectively of FIG. 2.

FIG. 9 is a fragmentary cross sectional view of the new assembly illustrating the procedure for installing the sealing strip.

FIG. 10 is a respective view of a modified form of door and frame incorporating the sealing arrangement of the present invention.

DETAILED DESCRIPTION OF THE INVENTION

FIG. 1 shows a closure member, typically a door 10 hinged on a frame 11, appropriate for use in the present invention. Running around the sides of the door 10 is a channel **10*a* provided with a continuous groove 12, shown in dashed lines, with a notch 13 at one easily accessible point. As demonstrated in FIG. 2, the groove 12 runs entirely around the door 10 in a closed loop. Inside the groove 12 and within the area of the notch 13 is an aperture 14, through which the inflatable sealing strip 15** will be inflated, as will be discussed later.

The details of the groove 12 and notch 13, as seen from the edge of the door, are more fully shown in FIG. 3. Running along the side flanges 16 of the groove 12 and partially overhanging it are fins 17. The fins 17 project inward from a level about halfway up the side flanges 16, dividing the groove 12 into an inner channel 18 and an outer channel 19 by a narrower throat area 20. The fins 17 are cut away in one region to form a groove notch 13, but otherwise run the entire length of the groove 12.

FIG. 4 shows the continuous sealing strip 15 in position within the groove 12. The sealing 15 is formed of neoprene or other appropriate elastomeric material and has a hollow inflatable outer portion 21, a narrow neck 22 and a base flange 23, creating a generally I-shaped cross section. The sealing strip is shown in its entirety in FIG. 5 as an endless loop.

At one point in the loop, as shown in FIG. 6, the side edges 24 of the base flange 23 are cut down to the width of the neck 22, to form strip notch 25. This strip notch 25 cooperates with the groove notch 13 to enable the sealing strip to be inserted within the groove 12.

Extending from the sealing strip 15, in the region of the strip notch, is a valve stem **14*a* passing from the interior of the inflatable top 21 and through the neck 22 and base flange 23. The stem 14*a* is inserted through the aperture 14 and is used to inflate the seal top 21 after the sealing strip 15** is in place.

FIG. 7 illustrates a cross-section of the groove 12 and the sealing strip 15, showing the strip notch 25 within the groove 12 at a point offset from the groove notch 13. In contrast, FIG. 4 shows cross-sections where the sealing strip is not notched. The wide base 23 holds the sealing strips 15 securely but slidingly in place, along almost the entire perimeter, while the two notches allow the sealing strip 15 to be mounted, as illustrated in FIG. 9.

The following procedure is followed for installation: First, the strip notch area 25 of the seal is placed into the groove notch 13, and the sealing strip 15 is slid around the groove 12. Because the groove notch 13 is wider than the base flange 23 and the neck area 22 adjacent the strip notch 25 is narrower than the throat area 20 of the groove, the leading edge 26 of the base flange 23 will slip under the fins 17 without interference, even though the sealing strip 15 is endless. The sealing strip 15 is then slid around a full 360° until the strip notch 25 and groove notch 13 are partially overlapped. At this point, the valve stem 14*a* is passed through the aperture 14, to be connected to an air source for inflation of the top portion 21.

It is thus very easy to mount the sealing strip 15. When mounted, the sealing strip 15 is securely held at almost every point along its length, so it cannot sag and cannot be dismounted by accidental contact.

In the embodiment of FIGS. 1–9, just described, the continuous sealing strip is mounted in the outer peripheral edge region of a door panel 10. In the modified embodiment of FIG. 10, a door or other closure panel 27 is provided with a peripheral flange 28 incorporating a forwardly facing notched groove 29. The notched groove 29 is of basically the same construction as the groove 12 of the first described embodiment, and is provided with a notched-out area 30. A flexible sealing strip 31 is provided, also of the same general construction as the sealing strip 15 of the first described embodiment. The strip 31, however, is oriented so that the inflatable sealing portion 32 faces forwardly, for contact with a surface (not shown) parallel to the door panel 27. The sealing element 31 is, of course, provided with a base flange and strip notch (not specifically illustrated) corresponding to those elements of the strip 15, to accommodate progressive lengthwise insertion of the endless seal 31 into the endless groove 29.

In either form of the invention, the specific length of the strip and groove notches is not especially critical, and will depend somewhat on the flexibility of the inflatable sealing element. Thus, during the inserting process, the leading edge portions 26 of the strip flange will be underneath the fins 17, while the trailing edges 26*a* (see FIG. 9) will lie above the fins. The neck area of the strip notch must be sufficiently long to accommodate this transitional configuration of the sealing strip without undue stress and/or friction. In a practical embodiment, a notch length of about four times the width of the base flange has proved to be satisfactory. Apart from this general guideline, both of the notch areas desirably are as short as practicable for maximum support of the sealing strip.

The structure of the invention represents a significant improvement in the mounting of endless, inflatable sealing strips for closure devices, in that it accommodates effectively continuous, full length securement of the sealing element. Both the sealing element itself and the grooved structure for mounting it are in the form of continuous, extrudable cross sections, providing desirable economies in manufacture.

It should be understood, of course, that the specific forms of the invention herein illustrated and described are intended to be representative only, as certain changes may be made therein without departing from the clear teachings of the disclosure. Accordingly, reference should be made to the following appended claims in determining the full scope of the invention.

I claim:

1. A sealable closure, comprising (a) a closure member having a substantially flat surface, (b) an endless, continuous, elongated flexible sealing strip having a uniform, generally I-shaped cross section, with broad base and top portions interconnected by a neck having a narrow width, relative to said base and top portions, (c) a continuous groove in said flat surface of the same length as the strip, (d) two continuous fins, running on either side of and overhanging the bottom of said groove, (e) said fins dividing said groove into a continuous inner channel and a continuous outer channel, separated by a throat, having a narrow width relative to the width of each of said inner and outer channels, (f) the base portion and the neck of said strip being proportioned to fit closely but slidingly within said inner channel and said throat, respectively, of said groove, (g) said continuous fins being arranged and configured to form an entrance slot-forming notch of limited length where said throat is wider than the base portion of said sealing strip, (h) the base portion of said strip being formed to include a finite section of reduced width relative to the remaining sections of the base portion where the base portion is narrower than said throat, (i) the notch being adapted to receive the base portion of said continuous strip, whereby the sealing strip may be inserted into the groove by initially placing the finite section of the base portion into the entrance slot-forming notch, sliding the base portion under the fins and into the inner channel, and sliding the sealing strip along the groove.

2. The closure according to claim 1, wherein the flat surface comprises the side edges of said door-like closusre member.

3. The closure according to claim 1 wherein the flat surface comprises the face of said door-like closure member.

4. A closure according to claim 1, wherein (a) the top portion of the sealing strip is inflatable.

5. A closure according to claim 1, wherein (a) the top portion is received closely and slidingly in said outer channel.

6. An inflatable closure assembly which comprises, (a) a rigid closure member provided with a generally continuous, endless groove, (b) a flexible, inflatable sealing element provided with a generally continuous, endless base flange, (c) said groove having opposed, continuous, flange-like fins forming a continuous confined groove section for the reception and retention of said base flange, (d) said continuous fins including opposed, notched-out portions of finite length to define an entrance slot-forming opening to said continuous confined groove section, (e) said continuous base flange including a finite section of reduced width, (f) whereby said continuous base flange may be inserted into said continuous, confined groove by intially placing said finite section of the base portion into the finite length entrance slot-forming opening defined by the continuous fins and sliding the base portion along the continuous groove.

7. The closure according to claim 1, wherein said closure member comprises a door-like closure member.

8. The closure according to claim 6, further characterized by (a) said flexible, inflatable sealing element including an inflation valve element projecting from said continuous, endless base flange in an area adjacent said finite section of reduced width, (b) said continuous, confined grooved section including a valve element-receiving aperture formed in the area of the opposed, notched-out portions of said continuous fins, (c) the finite section of reduced width of said continuous base flange and the opposed, notched-out portions of finite length of said continuous fins being at least partially offset lengthwise when said continuous base flange is inserted into said continuous, confined groove whereby said valve element may be received in said valve element-receiving aperture.

* * * * *